US011649638B2

(12) United States Patent
Bredeweg et al.

(10) Patent No.: US 11,649,638 B2
(45) Date of Patent: May 16, 2023

(54) BOARD AND BATTEN SIDING

(71) Applicant: QUALITY EDGE, INC., Walker, MI (US)

(72) Inventors: Mark Allen Bredeweg, Zeeland, MI (US); Kathryn Elizabeth Ostreko, Hudsonville, MI (US); Darrin Pritchard, Stanwood, MI (US); C. Scott Rasmussen, Ada, MI (US)

(73) Assignee: QUALITY EDGE, INC., Walker, MI (US)

( * ) Notice: Subject to any disclaimer, the term of this patent is extended or adjusted under 35 U.S.C. 154(b) by 62 days.

(21) Appl. No.: 17/235,993

(22) Filed: Apr. 21, 2021

(65) Prior Publication Data

US 2022/0341184 A1 Oct. 27, 2022

(51) Int. Cl.
*E04F 13/08* (2006.01)
*E04F 13/12* (2006.01)

(52) U.S. Cl.
CPC ..... *E04F 13/0864* (2013.01); *E04F 13/12* (2013.01)

(58) Field of Classification Search
CPC .... E04F 13/0864; E04F 13/12; E04F 13/0846
See application file for complete search history.

(56) References Cited

U.S. PATENT DOCUMENTS 2,258,247 A 10/1941 Hull
2,591,361 A 4/1952 Knott
2,642,968 A 6/1953 Roush et al.
3,188,774 A 6/1965 McCorkle
3,325,952 A 6/1967 Trachtenberg
3,473,274 A 10/1969 Godes
3,703,795 A * 11/1972 Mattes ..... E04F 13/0864 52/409
4,102,106 A 7/1978 Golder et al.
4,122,643 A 10/1978 Hafner
4,327,528 A 5/1982 Fritz
4,593,512 A 6/1986 Funaki
5,016,415 A 5/1991 Kellis
5,363,623 A 11/1994 King
5,465,486 A * 11/1995 King ..... B29D 99/001 29/434
5,560,170 A 10/1996 Ganser et al.
5,581,970 A 12/1996 O'Shea
5,598,677 A 2/1997 Rehm, III
5,694,728 A 12/1997 Heath, Jr. et al.
5,862,912 A 1/1999 Schelhorn
5,878,543 A 3/1999 Mowery
6,026,624 A * 2/2000 Patel ..... E04F 13/0864 52/529
6,223,488 B1 5/2001 Pelfrey et al.
6,295,777 B1 10/2001 Hunter et al.
6,516,577 B2 * 2/2003 Pelfrey ..... E04D 13/152 52/302.1
6,988,345 B1 1/2006 Pelfrey et al.
7,040,067 B2 5/2006 Mowery et al.
(Continued)

*Primary Examiner* — Rodney Mintz
(74) *Attorney, Agent, or Firm* — Price Heneveld LLP

(57) ABSTRACT

A board and batten siding panel is provided with the ability to hide the securing flange under siding panels installed on a building wall. The siding panel can be customized to have the look of a wooden panel, while retaining the benefits and durability of a non-wooden material, such as metal.

15 Claims, 8 Drawing Sheets

(56) References Cited

U.S. PATENT DOCUMENTS

| | | | | |
|---|---|---|---|---|
| 7,685,787 | B1 * | 3/2010 | Mollinger | E04F 21/1855 52/459 |
| 8,006,455 | B1 | 8/2011 | Mollinger et al. | |
| 8,336,269 | B1 | 12/2012 | Mollinger et al. | |
| 8,381,472 | B1 | 2/2013 | Fleenor | |
| 9,068,362 | B1 | 6/2015 | Baxter et al. | |
| 10,458,123 | B2 * | 10/2019 | Culpepper | B32B 13/045 |
| 10,508,455 | B1 * | 12/2019 | Bredeweg | E04F 13/0889 |
| 10,612,245 | B2 * | 4/2020 | Culpepper | B32B 3/30 |
| 10,760,282 | B2 * | 9/2020 | Bredeweg | E04F 13/0889 |
| 11,255,092 | B2 * | 2/2022 | Rasmussen | E04F 13/0864 |
| 11,421,423 | B2 * | 8/2022 | Bredeweg | E04F 13/12 |
| 2002/0020125 | A1 * | 2/2002 | Pelfrey | E04F 13/0864 52/302.1 |
| 2006/0053715 | A1 | 3/2006 | Mowery et al. | |
| 2006/0075712 | A1 | 4/2006 | Gilbert et al. | |
| 2008/0141607 | A1 | 6/2008 | Stoecker | |
| 2009/0126286 | A1 | 5/2009 | Sigmund et al. | |
| 2009/0301015 | A1 | 12/2009 | Simms | |
| 2010/0064611 | A1 | 3/2010 | Holt et al. | |
| 2016/0153197 | A1 | 6/2016 | Baum, Jr. | |
| 2018/0202166 | A1 * | 7/2018 | Culpepper | B32B 27/065 |
| 2018/0202167 | A1 * | 7/2018 | Culpepper | E04F 13/0866 |
| 2020/0032521 | A1 * | 1/2020 | Culpepper | B32B 7/14 |
| 2020/0181922 | A1 * | 6/2020 | Bredeweg | E04F 13/0864 |
| 2020/0392740 | A1 * | 12/2020 | Bredeweg | E04F 13/0889 |
| 2021/0025175 | A1 * | 1/2021 | Rasmussen | E04F 13/0846 |

* cited by examiner

BOARD AND BATTEN SIDING

BACKGROUND

The present invention generally relates to modular, board and batten siding and, more specifically, to modular board and batten siding that has the look of wood despite being made from a non-wood material.

BRIEF SUMMARY OF THE INVENTION

One aspect of the present invention is a siding panel to be attached to a building. The siding panel is an elongated body with a multi-tiered outer face. A securing flange portion is located at a first end of the elongated body. The securing flange portion is generally vertical when the elongated body is attached in a generally vertical manner to a surface of a building. The elongated body also has a receiving channel located near the side of the securing flange portion. The receiving channel has an opening with a first distance and an end with a second distance that is longer than the first distance. The elongated body has a tab portion at a second end of the elongated body. The tab portion will be generally vertical when the elongated body is attached in a generally vertical manner to a surface of a building. The tab portion extends from a second end surface extending from a tier of a multi-tiered outer face adjacent to the second end. The tab portion has a peak that is formed between the first angled surface and a second angled surface. The height of the peak in comparison to the intersection of the second end surface and the first angled surface of the tab portion is a third distance. The third distance is longer than the first distance of the opening in the receiving channel.

In another aspect, the invention includes a building siding system. The building siding system includes a plurality of siding panels having an elongated body with a multi-tiered outer face. The siding panels have a securing flange portion at a first end of the elongated body, with the securing flange portion being generally vertical when the elongated body is attached in a generally vertical orientation to the surface of a building. A receiving channel is located near the side of the securing flange portion. The receiving channel has an opening with a first distance and an end with a second distance that is longer than the first distance. The elongated body has a tab portion at a second end, being generally vertical when the elongated body is attached in a generally vertical orientation to the surface of a building. The tab portion extends from a second end surface extending the tier of a multi-tier outer face adjacent to the second end. The tab portion has a peak that is formed between the first angled surface and a second angled surface. The height of the peak in comparison to the intersection of the second end surface and the first angled surface of the tab portion is a third distance. The third distance is longer than the first distance of the receiving channel. The tab portion of one siding panel is received in the receiving channel of an adjacent siding panel such that the peak of the tab portion is positioned between the opening and the end of the receiving channel.

In yet a further aspect, the invention includes a siding panel with an elongated body having a multi-tiered outer face. The securing flange portion is located at a first end of the elongated body and is generally parallel to the multi-tiered outer face. A receiving channel extends from one of the tiers of the multi-tiered outer face located adjacent to the securing flange portion. The receiving channel has an opening with a first height and an end with a second height that is longer than the first height. A tab portion is located at the second end of an elongated body. The tab portion extends from the second end surface extending from the tier of the multi-tiered outer face adjacent to the second end. The tab has a peak that is formed between a first angled surface and a second angled surface. The height of the peak in comparison to the intersection of the second end surface and the first angled surface of the tab portion is a third height. The third height of the peak is longer than the first height of the receiving channel.

These and other features, advantages, and objects of the present invention will be further understood and appreciated by those skilled in the art by reference to the following specification, claims, and appended drawings.

DETAILED DESCRIPTION

Figure 1:
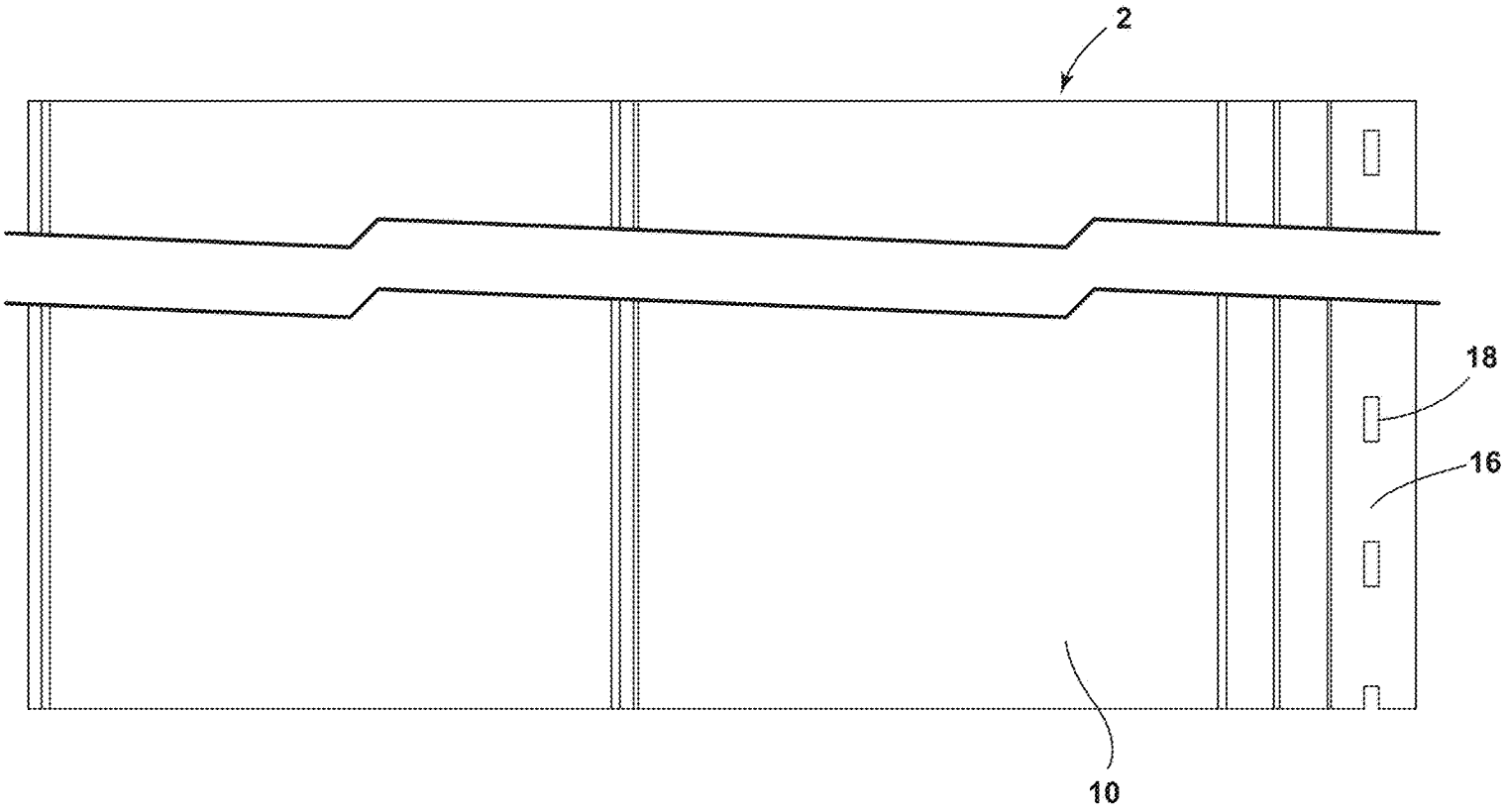
FIG. 1 is a partial rear view of a siding panel according to one embodiment of the present invention.

As referenced in the figures, the same reference numerals may be used herein to refer to the same parameters and components or their similar modifications and alternatives. For purposes of description herein, the terms "upper," "lower," "right," "left," "rear," "front," "vertical," "horizontal," and derivatives thereof shall relate to the present disclosure as oriented in the Figures. However, it is to be understood that the present disclosure may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Figure 2:
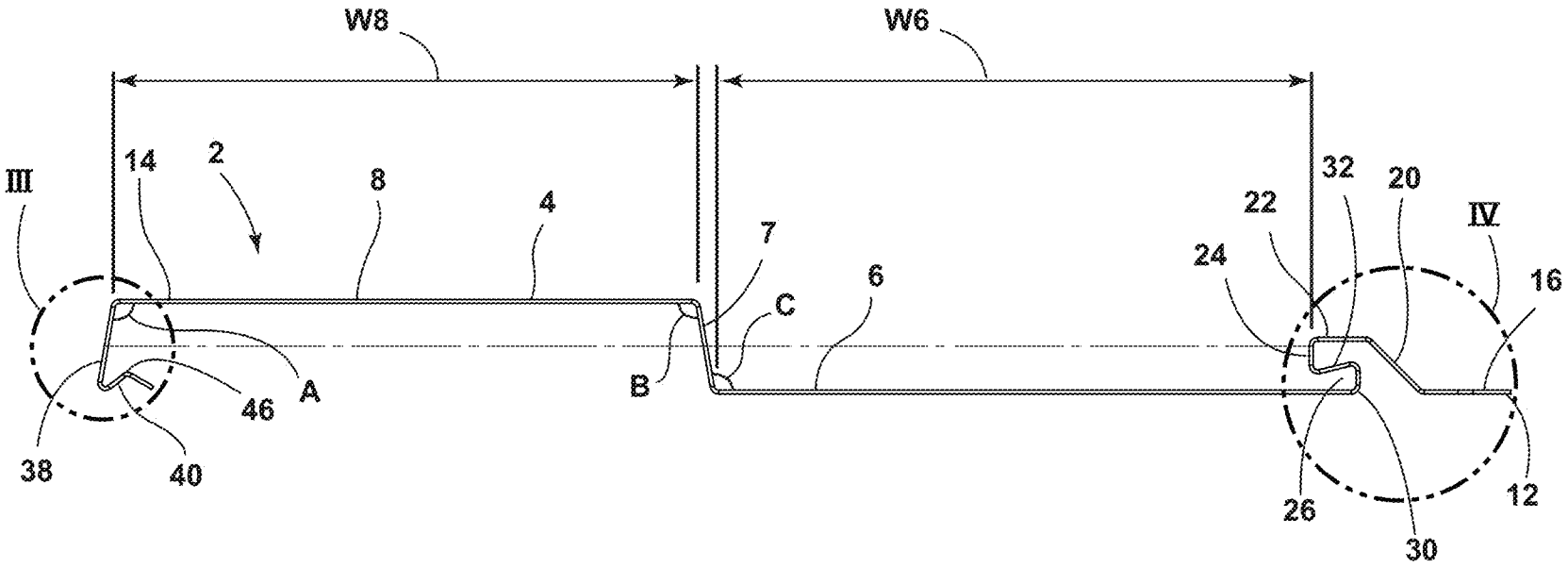
FIG. 2 is a cross-sectional view of the siding panel shown in FIG. 1.

As referred to in FIGS. 1-5, an embodiment of a siding panel 2 is shown. The siding panel 2 is an elongated body with an outer face 4 and an inner face 10. The outer face 4 includes multiple tiers. In the embodiment shown in FIGS. 1-5, the outer face 4 has a first end tier 6 and a second end tier 8 that are connected by a wall 7. In the illustrated embodiment, the wall 7 is an angled wall that has angles B (between the wall 7 and the second end tier 8) and C (between the wall 7 and first end tier 6) that are larger than 90°, as shown in FIG. 2. The siding panel 2 can include more than two tiers, and the walls 7 that separate the tiers can be straight, angled, and/or include multiple surfaces on the walls 7. The siding panel 2 includes a first end 12 and a second end 14. The first end 12 and second end 14 will be spaced apart horizontally when the siding panel 2 is installed in a generally vertical manner on the side of a building.

A securing flange portion 16 is located at the first end 12. The securing flange portion 16 includes a plurality of fastener openings 18 to permit fasteners to secure the securing flange portion 16 to the side of a building. When the siding panel 2 is installed in a vertical manner, the fastener openings 18 will be generally spaced apart vertically on the side of the building. A first end wall 20 extends from the securing flange portion 16. As illustrated in FIG. 2, first end wall 20 can be angled. A generally flat section 22, which is generally parallel to the first end tier 6, is connected to the first end wall 20. A generally straight surface 24 extends generally perpendicular to the first end tier 6, as illustrated in FIG. 2.

Figure 4:
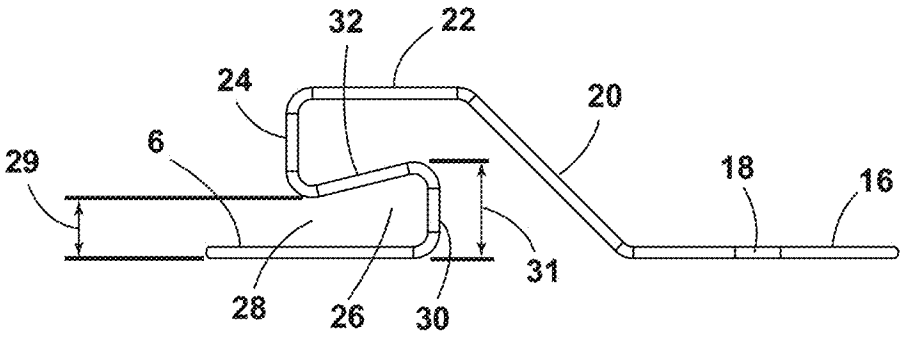
FIG. 4 is an enlarged cross-sectional view of the siding panel shown in FIG. 1, taken along line IV as shown in FIG. 2.

A receiving channel 26 is defined by the space between the first end tier 6 and an angled wall 32 that is connected to the generally straight surface 24 and the end wall 30 of the receiving channel 26. The receiving channel 26 has an opening 28 with a first height 29 and a second height 31 at the end 30. The first height 29 is smaller than the second height 31, as illustrated in FIG. 4. The reference to the heights 29, 31 of the receiving channel 26 are done in the context of viewing the receiving channel 26 from a cross-sectional view, as illustrated in FIG. 4.

Figure 3:
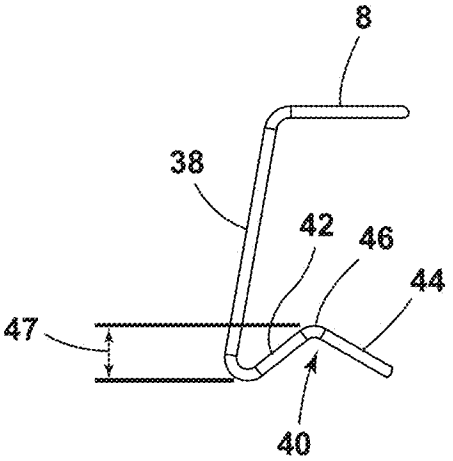
FIG. 3 is an enlarged cross-sectional view of the siding panel shown in FIG. 1, taken along line III as shown in FIG. 2.
Figure 5:
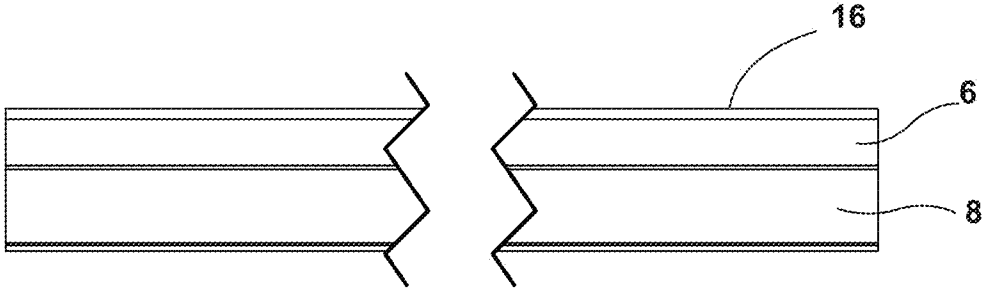
FIG. 5 is a bottom view of the siding panel shown in FIG. 1.
Figure 6:
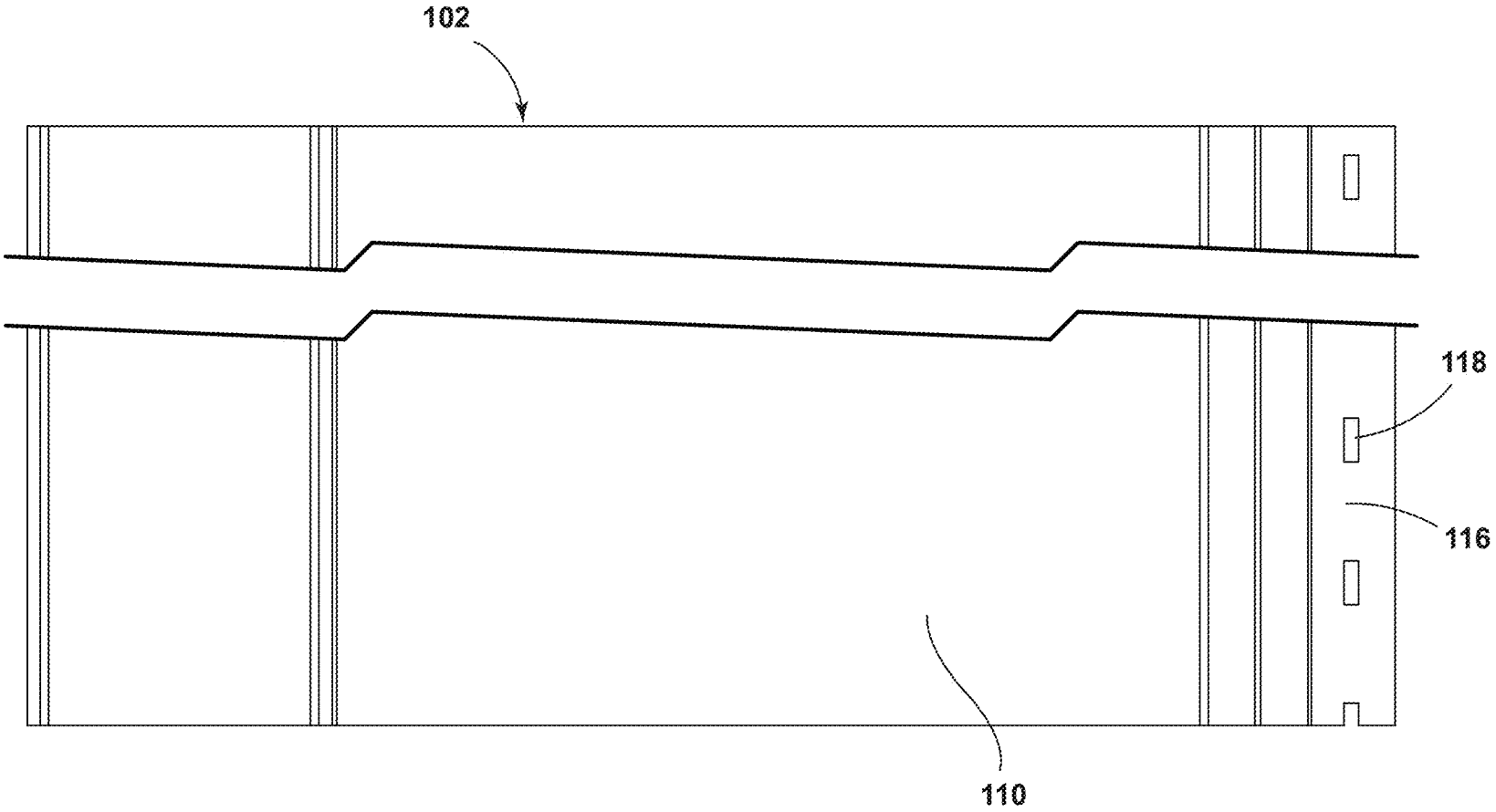
FIG. 6 is a partial rear view of a siding panel according to another embodiment of the present invention.

A tab portion 40 is located near the second end 14 of the siding panel 2. The tab portion 40 includes a peak 46 that is formed in between a first angled surface 42 and a second angled surface 44, as illustrated in FIG. 3. The height 47 of the peak 46 is measured from the bottom of the first angled surface 42 where it intersects the second end wall 38. The angle A between the second end wall 38 and the second end tier 8 is greater than 90°, as shown in FIG. 2. Height 47 is greater than the first height 29 of the receiving channel 26. This permits the tab portion 40 to be received and retained in the receiving channel 26 when adjacent siding panels 2 are coupled together. The coupling of the tab portion 40 in the receiving channel 26 can be accomplished by sliding the tab portion 40 into the receiving channel 26 or can be accomplished by inserting the tab portion 40 into the receiving channel 26 from an angle and then rotating one siding panel 2 with respect to the other siding panel 2. This friction lock prevents water from working behind the siding panel 2 and provides tension for a snap-like fit between adjacent siding panels 2.

In the illustrated embodiment of FIGS. 1-5, the first end tier 6 and second end tier 8 are approximately the same width (W6, W8). For example, once assembled, the first end tier 6 of one panel and the second end tier 8 of adjacent panels could result in visually equal tiers, such as each appearing to have the same width with a 5" raised tier (W8) next to a 5" lowered tier (W6). Also, in the illustrated embodiment, the terminal ends of the second angled surface 44 and the first end 12 are rounded for safety in installation to prevent potentially sharp corners. The tiers 6, 8 can be of different widths and different heights.

Figure 7:
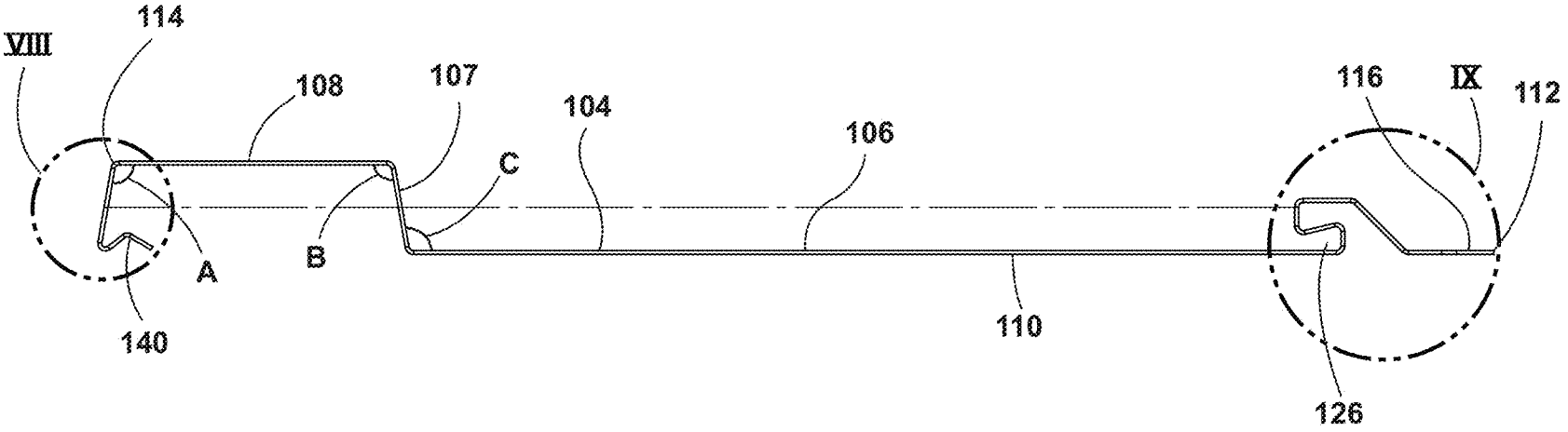
FIG. 7 is a cross-sectional view of the siding panel shown in FIG. 6.
Figure 9:
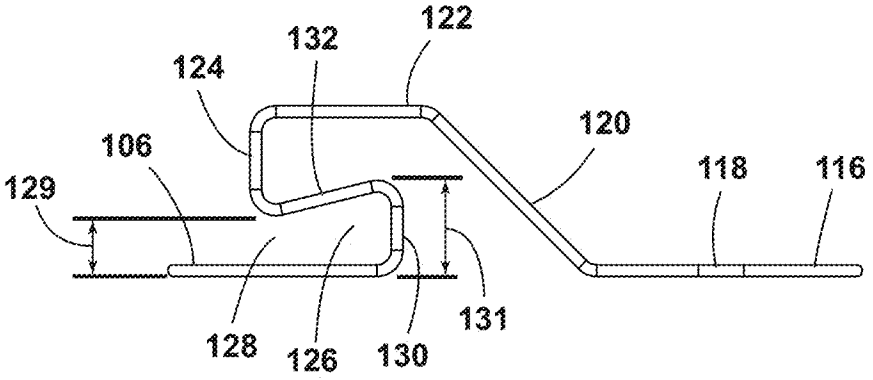
FIG. 9 is an enlarged cross-sectional view of the siding panel shown in FIG. 6, taken along line IX, as shown in FIG. 7.

Another embodiment of siding panel 102 is shown in FIGS. 6-10. In that embodiment, the first end tier 106 is wider than the second end tier 108. The siding panel 102 includes a first end 112 and a second end 114. The siding panel 102 also has an outer face 104 and an inner face 110. A wall 107 connects the first end tier 106 and the second end tier 108. The wall 107 can be angled, as illustrated in FIG. 7. A securing flange portion 116 is located at the first end 112. The securing flange portion 116 includes a plurality of fastener openings 118. A first end wall 120, which can be angled, extends from the securing flange portion 116 to a generally flat section 122. A generally straight surface 124 extends from the generally flat section 122. A receiving channel 126 is formed between an angled surface 132 that connects to the generally straight surface 124 and the end 130 of the receiving channel 126. The receiving channel 126 will have an opening 128 with a first height 129 and a second height 131 that is at the end 130.

Figure 8:
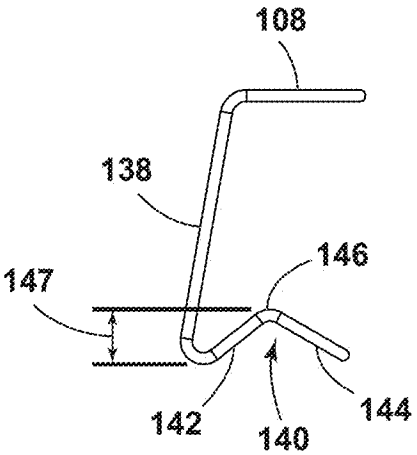
FIG. 8 is an enlarged cross-sectional view of the siding panel shown in FIG. 6, taken along line VIII, as shown in FIG. 7.
Figure 10:
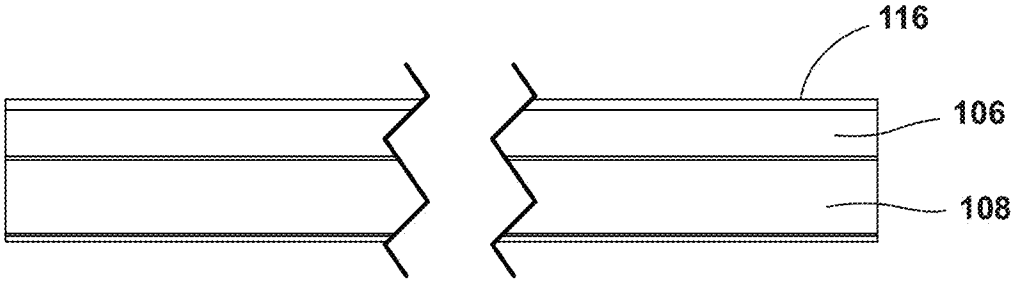
FIG. 10 is a bottom view of the siding panel shown in FIG. 6.
Figure 11:
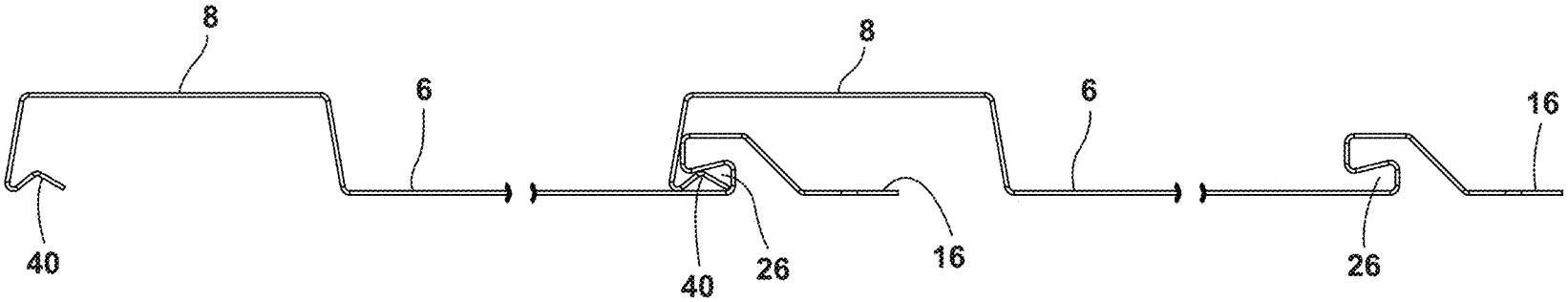
FIG. 11 shows adjacent siding panels of either FIG. 1 or FIG. 6, connected together.

A tab portion 140 is located at the second end 114 of the siding panel 102. A second end wall 138, which can be angled, extends from the second end tier 108. A first angled surface 142 extends from the second end wall 138, as illustrated in FIG. 8. A second angled surface 144 extends from the first angled surface 142 to create a peak 146. The peak 146 has a third height 147 when measured to the bottom of the first angled surface 142 connected to the second end surface 138. The third height 147 will be greater than the first height 129 of the receiving channel 126 thereby permitting the tab portion 140 to be received and secured within the receiving channel 126 when adjacent panels 102 are installed to each other.

While the illustrated embodiments show outer faces 4, 104 having two tiers (6, 106 and 8, 108), three or more tiers can be used with the siding panels 2, 102. Moreover, the relative width and height of the tiers with respect to each other can be adjusted. Moreover, while angles A, B, and C are illustrated as greater than 90° creating a shadowed design, alternative embodiments could utilize one or more angles A, B, or C less than 90°.

Figure 12:
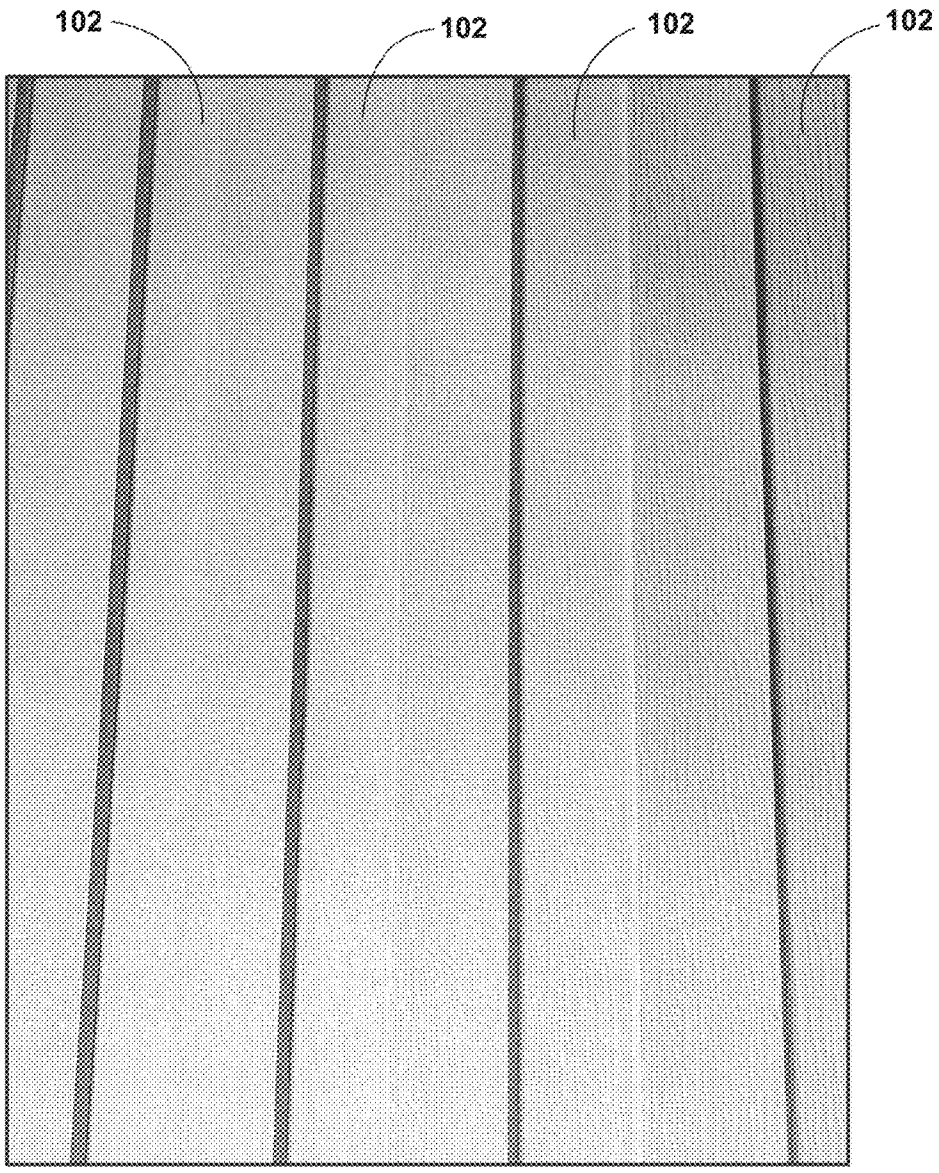
FIG. 12 illustrates a number of siding panels of the siding panels shown in FIG. 1 installed together on the wall of a building.

The siding panel 2 is shown in FIG. 12 as being installed in a generally vertical manner on a building wall. It should be recognized that the siding panels 2, 102, can be installed in other orientations and references to heights and widths are made in accordance with the orientations and cross-sectional views as illustrated in the drawings. For example, the siding panels 2, 102 can be installed horizontally on a wall, installed on a ceiling, installed as soffit, etc.

The illustrated embodiments do not use clips between adjacent panels, resulting in a clipless installation. The only securing mechanism necessary is the use of fasteners, such as screws, nails, etc. in the fastening openings 18. Alternatively, additional securing mechanisms could be used to connect or locate adjacent panels to each other. This could include parts that overlap laterally adjacent panels.

The siding panels 2, 102 can be installed on multiple different types of backing surfaces and/or underlayments. This includes, but is not limited to, wood, polymeric materials, foam, metal, concrete, and material covered with underlayments, including water-proofing underlayments.

The outer face 4, 104 of siding panels 2, 102 can be painted, printed, stamped, embossed, and/or formed to look like wood. The outer face 4, 104 can have varying color and grain options to look like wood and so that adjacent panels 2, 102 look slightly different.

Those skilled in the art will recognize, or will be able to ascertain using no more than routine experimentation, many equivalents to the specific embodiments of the invention described herein. Such equivalents are intended to be encompassed by the following claims.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

It will be understood by one having ordinary skill in the art that construction of the present disclosure and other components is not limited to any specific material. Other exemplary embodiments of the disclosure disclosed herein may be formed from a wide variety of materials, unless described otherwise herein.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A siding panel, comprising:

an elongated body configured to be attached to a substantially vertical surface of a building in an installed configuration, the elongated body having a multi-tiered outer face including a first outer face tier and a second outer face tier that are connected by an angled wall, the multi-tiered outer face, comprising:

a securing flange portion at a first end of said elongated body that is substantially parallel to said multi-tiered outer face;

a receiving channel extending from one of the tiers of said multi-tiered outer face located adjacent to said securing flange portion, said receiving channel having an opening with a first height and an end with a second height that is longer than said first height;

a tab portion at a second end of said elongated body, wherein:

said tab portion extends from a second end surface extending from the tier of the multi-tier outer face adjacent to said second end; and said tab portion has a peak that is formed between a first angled surface and a second angled surface, a height of said peak in comparison to an intersection of said second end surface and said first angled surface of said tab portion being a third height; and wherein said third height is longer than said first height; and wherein, in the installed configuration, one of:

(i) said first outer face tier is wider than said second outer face tier, (ii) said first outer face tier and said second outer face tier are approximately the same width, or (iii) said second outer face tier is wider than said first outer face tier.

2. An elongated siding panel, comprising:

an elongated body configured to be attached to a substantially vertical surface of a building in an installed configuration, the elongated body having a multi-tiered outer face including a first outer face tier and a second outer face tier that are connected by an angled wall, the multi-tiered outer face comprising:

a securing flange portion at a first end of said elongated body, said securing flange portion being substantially vertical in the installed configuration;

a receiving channel located near an opposite side of said securing flange portion, said receiving channel having an opening with a first distance and an end with a second distance that is longer than said first distance;

a tab portion at a second end of said elongated body, said tab portion being substantially vertical in the installed configuration, wherein:

said tab portion extends from a second end surface extending from the tier of the multi-tier outer face adjacent to said second end; and said tab portion has a peak that is formed between a first angled surface and a second angled surface, a height of said peak in comparison to an intersection of said second end surface and said first angled surface of said tab portion being a third distance; and wherein said third distance is longer than said first distance; and wherein, in the installed configuration, one of:

(i) said first outer face tier is wider than said second outer face tier, (ii) said first outer face tier and said second outer face tier are approximately the same width, or (iii) said second outer face tier is wider than said first outer face tier.

3. The elongated siding panel of claim 2, wherein said peak of said tab portion is positioned in between said opening and said end of the receiving channel of an adjacent elongated siding panel.

4. The elongated siding panel of claim 2, wherein said third distance is approximately 0.02 inches longer than said first distance.

5. The elongated siding panel of claim 2, wherein said elongated body is formed of metal.

6. The elongated siding panel of claim 2, wherein the end of said receiving channel includes a surface extending away from said first outer face tier that connects to an inclined surface leading to the opening of the receiving channel.

7. The elongated siding panel of claim 6, wherein said first end of said elongated body includes an angled surface extending from said securing flange portion to a substantially flat section that is substantially parallel to said first outer face tier, said substantially flat section being positioned above said receiving channel by a substantially straight surface that is substantially perpendicular to said first outer face tier.

8. A building siding system, comprising:

a plurality of siding panels configured to be attached to a substantially vertical surface of a building in an installed configuration, each siding panel having an elongated body with a multi-tiered outer face including a first outer face tier and a second outer face tier that are connected by an angled wall, the multi-tiered outer face, comprising:

a securing flange portion at a first end of said elongated body, said securing flange portion being substantially vertical in the installed configuration;

a receiving channel located near an opposite side of said securing flange portion, said receiving channel having an opening with a first distance and an end with a second distance that is longer than said first distance;

a tab portion at a second end of said elongated body, said tab portion being substantially vertical in the installed configuration, wherein:

said tab portion extends from a second end surface extending from the tier of the multi-tier outer face adjacent to said second end; and said tab portion has a peak that is formed between a first angled surface and a second angled surface, a height of said peak in comparison to an intersection of said second end surface and said first angled surface of said tab portion being a third distance;

wherein said third distance is longer than said first distance; and wherein the tab portion of one siding panel is received in the receiving channel of an adjacent siding panel such that said peak of said tab portion is positioned between the opening and the end of the receiving channel.

9. The building siding system of claim 8, wherein said first outer face tier is wider than said second outer face tier.

10. The building siding system of claim 8, wherein said first outer face tier and said second outer face tier are approximately the same width.

11. The building siding system of claim 8, wherein said second outer face tier is wider than said first outer face tier.

12. The building siding system of claim 8, wherein said third distance is approximately 0.02 inches longer than said first distance.

13. The building siding system of claim 8, wherein said elongated body is formed of metal.

14. The building siding system of claim 8, wherein the end of said receiving channel includes a surface extending away from said first outer face tier that connects to an inclined surface leading to the opening of the receiving channel.

15. The building siding system of claim 14, wherein said first end of said elongated body includes an angled surface extending from said securing flange portion to a substantially flat section that is substantially parallel to said first outer face tier, said substantially flat section being positioned above said receiving channel by a substantially straight surface that is substantially perpendicular to said first outer face tier.

* * * * *